US005813846A

United States Patent [19]

Newby et al.

[11] Patent Number: 5,813,846

[45] Date of Patent: Sep. 29, 1998

[54] LOW NOX FLAT FLAME BURNER

[75] Inventors: John N. Newby, Lexington, Ky.; Robert A. Shannon, Avon Lake; Keith J. Nieszczur, Seven Hills, both of Ohio

[73] Assignee: North American Manufacturing Company, Cleveland, Ohio

[21] Appl. No.: 832,570

[22] Filed: Apr. 2, 1997

[51] Int. Cl.[6] ..... F23M 3/00

[52] U.S. Cl. ..... 431/9; 431/284; 431/348

[58] Field of Search ..... 431/348, 284, 431/9

[56] References Cited

U.S. PATENT DOCUMENTS

| | | | |
|---|---|---|---|
| 2,935,128 | 5/1960 | Ferguson | 431/284 |
| 3,074,361 | 1/1963 | Huge et al. | 431/284 |
| 3,115,924 | 12/1963 | Massier | 431/284 |
| 3,424,542 | 1/1969 | Hirschberg et al. | 431/348 |
| 4,094,625 | 6/1978 | Wang et al. | 431/9 |
| 4,378,205 | 3/1983 | Anderson . | |
| 4,496,306 | 1/1985 | Okigami et al. . | |
| 4,945,841 | 8/1990 | Nakamachi et al. . | |
| 5,154,599 | 10/1992 | Wunning . | |
| 5,195,884 | 3/1993 | Schwartz et al. . | |
| 5,201,650 | 4/1993 | Johnson . | |
| 5,263,849 | 11/1993 | Irwin et al. . | |
| 5,271,729 | 12/1993 | Gensler et al. | 431/348 |
| 5,511,970 | 4/1996 | Irwin et al. | 431/9 |
| 5,697,776 | 12/1997 | Van Eerden et al. | 431/348 |

*Primary Examiner*—Carroll B. Dority
*Attorney, Agent, or Firm*—Jones, Day, Reavis & Pogue

[57] ABSTRACT

A flat flame burner is disclosed having flow passages for admitting fuel and air to a burner tile. A structure for producing a rotational flow cooperates with a divergent burner tile in order to produce a radially-divergent flame with a very small axial component and a high degree of entrainment of inert combustion products in a furnace. A portion of the fuel is injected into the entrained furnace products, in order to suppress the rate of combustion, so as to produce an ultra low NOx flat flame burner. The present invention also permits greater versatility and improved operability over previous flat flame burners.

12 Claims, 3 Drawing Sheets

LOW NOX FLAT FLAME BURNER

BACKGROUND OF THE INVENTION

The present invention is directed to the field of flat flame burners of the type producing a flame which generally propagates along a surface, for applications which require large radiative heat transfer. A typical previous flat flame burner 10 is shown in FIG. 1A. A first reactant, typically air, is flowed through a first passage 12. A vortical flow is produced in the first passage 12 by using a number of flow rotating devices such as are known in the art. For example, the body design of the first passage 12 can be formed to produce a rotating flow. Also,a discrete device such as a flame stabilizer 14 can be used, alone or in combination with the body design, to produce a rotating vortical flow. Other types of discrete devices can be used and include offset air connectors, "half moon" inlet spinners, swirlers, etc. such as are known in the art. As shown in FIG. 1B, the flame stabilizer 14 is a plate with a number of apertures having a particularly chosen geometry that produces a highly vortical flow.

A second reactant, typically fuel, is added to the air flow through a second passage 18 at an injection port 16. The resulting fuel/air mixture combusts downstream of the stabilizer 14, proximate to the burner tile 20. The burner tile 20 has a divergent profile, typically hyperboloidal. The rotating vortical flow diverges radially from the burner axis, following the profile of the hyperboloidal burner tile 20. Combustion facilitates the radial divergence, producing a radially-expanding flame front with a very small axial component.

The radially-diverging flame produces a thin, flat flame front, typically less than ten inches in thickness, which follows the flared surface of the burner tile 20. In this way, the flat flame has a large surface area to radiate energy from the flame, thus heating the work without flame impingement. The radially-diverging flame creates a central recirculation zone 22 about the burner axis, drawing the inert products of combustion from the furnace atmosphere into the outward portion of the flame envelope. As the flame front closely follows the profile of the burner tile, the central area around the burner axis is cooler than the outlying areas.

Nitrogen oxides, or NOx emissions are generated by combustion systems where nitrogen and oxygen are present within a locally high temperature region. The abbreviation NOx is chemical shorthand for the combined species of NO and NO2. The emission of these species pose a significant health hazard in ambient air as well as having other detrimental environmental effects. NOx emissions play a major role in photochemical smog and acid rain, both found in industrial areas around the world. Flat flame burners are inherently low NOx producers, because the high recirculation rate of inert products of combustion provides a relatively low temperature combustion reaction. However, in spite of relatively low levels of NOx production, environmental pressures from regulatory agencies are creating a need for ultra low NOx flat flame burners. Several application areas, such as roof-fired aluminum melters and steel reheat furnaces, require flat flame burners using preheated air with NOx emission levels below 100 ppmv. Some previous flat flame burner designs reduce NOx by passing flue gas through the burner to suppress flame temperatures. However, such designs are very complicated and expensive, requiring much extra hardware. Also, performance is degraded with such designs since firing capacity and available heat are reduced.

BRIEF DESCRIPTION OF THE INVENTION

In view of the above, there is a need for a flat flame burner with low levels of NOx production.

There is also a need for a low NOx flat flame burner having a less complex design.

There is also a need for a low NOx flat flame burner that is less expensive to produce.

There is also a need for a low NOx flat flame burner that does not reduce firing capacity or lower available heat.

These needs and others are satisfied by the flat flame burner of the present invention in which a burner tile is provided for reacting a combustible mixture to produce a flame. The burner tile has an outlet with a radially divergent surface, and a first passage admits a first reactant flow into the burner tile. A second passage is provided which includes a primary injector for admitting a first flow of a second reactant into the first reactant flow, so as to create the combustible mixture. A flow rotating means is provided within the first passage for producing a rotational flow within the first reactant flow. This rotational flow cooperates with the divergent surface of the burner tile to produce a radially divergent flame at the outlet. The rotational flow entrains inert gases from the furnace environment ambient to the burner. The second passage also includes a secondary injector for admitting a second flow of second reactant into the entrained inert gases.

As will be appreciated, the invention is capable of other and different embodiments, and its several details are capable of modifications in various respects, all without departing from the invention. Accordingly, the drawings and description are to be regarded as illustrative in nature and not restrictive.

BRIEF DESCRIPTION OF THE DRAWINGS

The embodiments of the invention will now be described by way of example only, with reference to the accompanying figures wherein the members bear like reference numerals and wherein.

DETAILED DESCRIPTION OF THE INVENTION

Figure 1A:
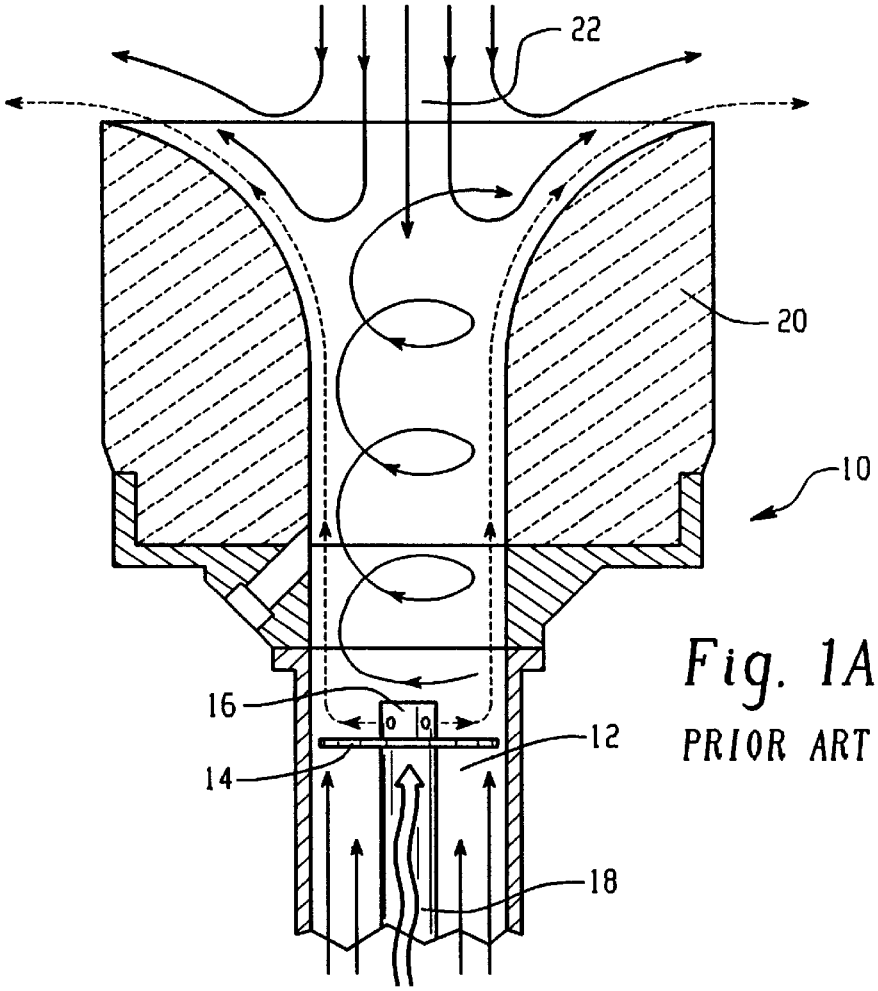
Fig. 1A PRIOR ART
FIGS. 1A and 1B are respective side sectional and top view showing the structure and operation of a previous flat flame burner.
Figure 1B:
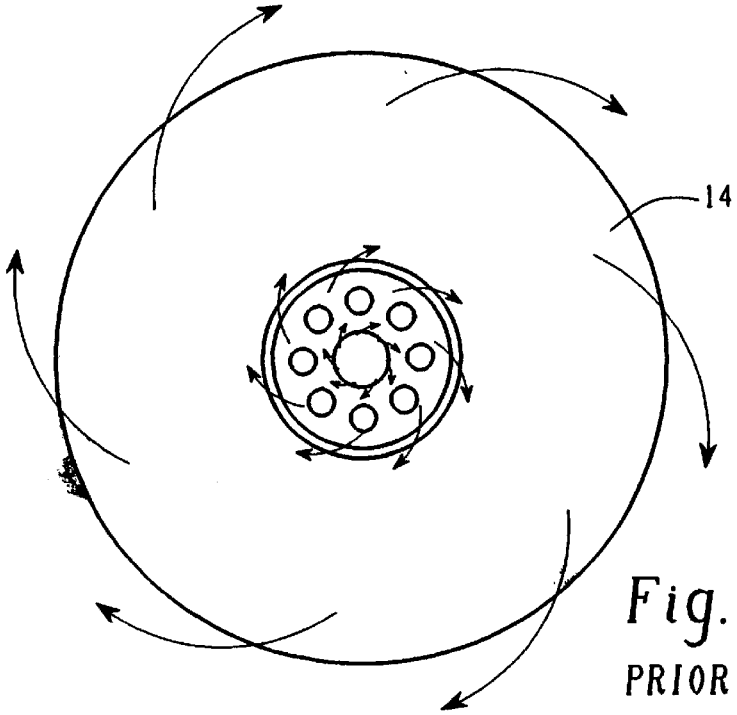
Fig. 1B PRIOR ART
Figure 2:
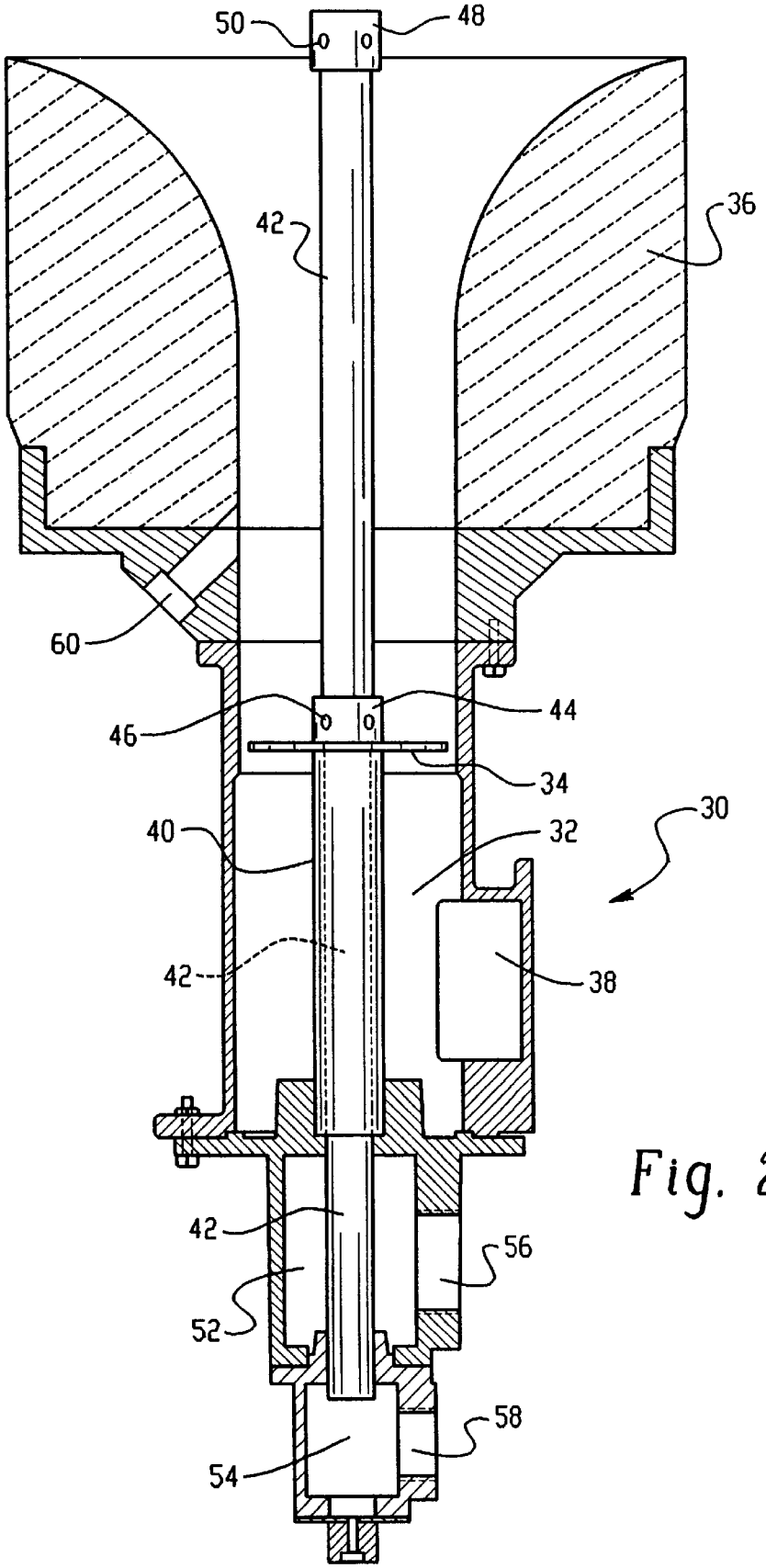
FIG. 2 is a side sectional view depicting the flat flame burner of the present invention.
Figure 3:
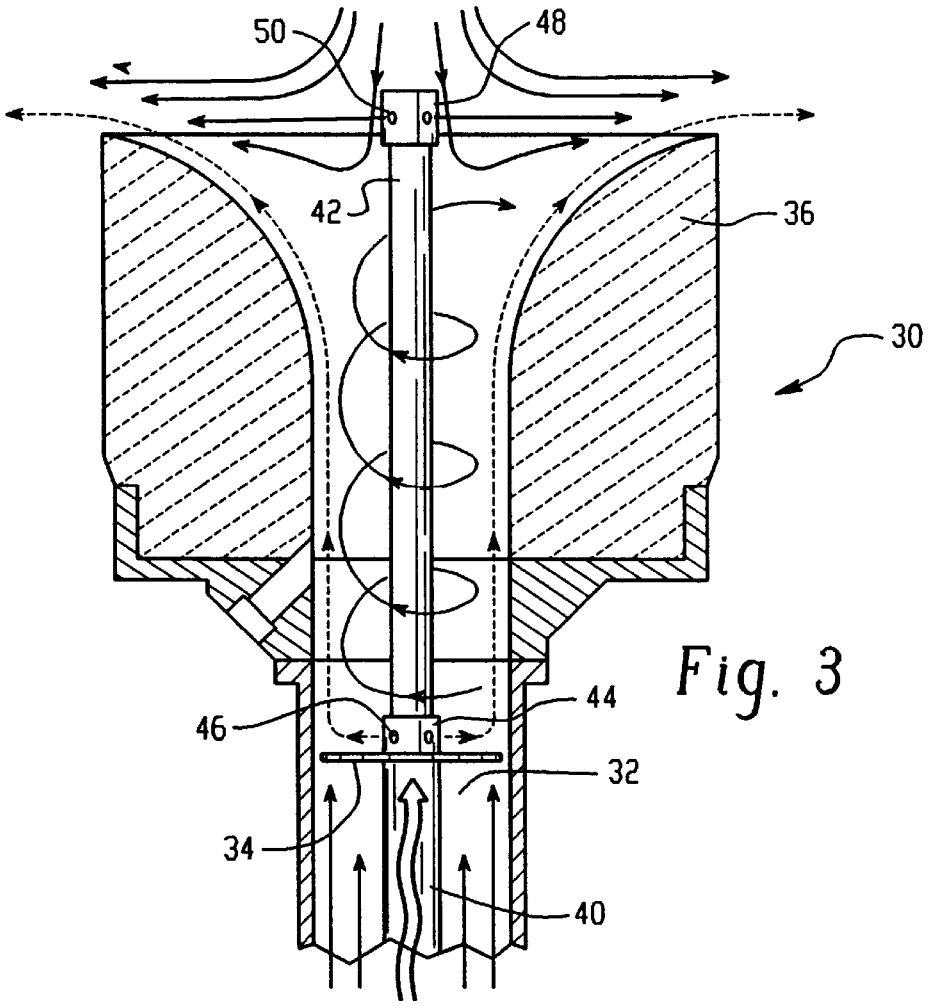
FIG. 3 is a side sectional view showing the structure and operation of the present flat flame burner.

FIGS. 2 and 3 show the structure and operation of the flat flame burner 30 of the present invention. As illustrated herein, the burner is preferably air-primary, i.e. the primary reactant is air. The present burner includes a first passage for supplying the primary reactant flow, including a combustion air plenum 32 for admitting a flow of combustion air from an external source. A flow rotating structure is provided for producing rotational flow within the air stream. For example, the flow rotating structure can be integral with a body design, alone or in combination with a discrete structure such as an offset air connector, a "half moon" inlet spinner, a swirler or a flame stabilizer 34 (as illustrated). A radially-divergent burner tile 36 is provided, preferably hyperboloidal in profile. However, the burner tile 36 can have a profile which is either substantially straight, curved or discontinuous, with at least a section that is conical or conic-sectional in shape. The rotational flow cooperates with the divergent burner tile 36 to produce a radially-divergent flow pattern. Air is supplied to the air plenum 32 through a combustion air inlet 38, which is connected to a remote air supply.

As illustrated herein, the secondary reactant flow, preferably gaseous hydrocarbon fuel, is supplied to the air stream in two stages. However, the present invention can also use a liquid fuel without departing from the invention. A second passage is provided for supplying fuel and includes a primary fuel passage 40 and a secondary fuel passage 42 which are preferably concentrically mounted along the burner axis. In the preferred embodiment, the present burner is air-primary; however, it will be appreciated that the present burner can also be fuel-primary without departing from the invention. The primary gas passage 40 supplies fuel to the combustion air through a primary gas injector 44 within the first passage 32 at a position upstream of the burner tile 36. The primary injector 44 includes at least one aperture, preferably a plurality of primary gas injection ports 46. However, the aperture can also be a continuous annulus. The secondary gas passage 42 supplies fuel substantially proximate to the burner outlet through a secondary gas injector 48, which includes a plurality of secondary gas injection ports 50, preferably four. Fuel is supplied to the respective gas passages through a primary gas plenum 52 and a secondary gas plenum 54, which each have respective inlets 56, 58 for admitting fuel.

During operation of the present burner 30, combustion air is supplied to the burner tile 36 through the air plenum 32. The combustion air can be supplied at ambient temperature or preheated at temperatures such as are commonly used in burners. During startup, fuel flows through the primary and secondary gas passages 40, 42 preferably in substantially equal proportions (i.e. 50% of the total fuel through each passage). A pilot is supplied through the pilot port 60 for igniting the fuel/air mixture at the primary injector 44. The pilot can be operated in permanent, intermittent and interrupted modes, such as are known in the art. In order to insure flame stability at low temperature, such as during startup, the proportions of fuel and air are controlled so that the combustible mixture runs lean (i.e. with excess air) in the primary stage at the primary injector 44. Secondary gas is supplied through the secondary injector 48 to the products of the primary stage in order to achieve substantially stoichiometric second-stage firing. In this two-stage operating mode, NOx levels are reduced to about 80–100 ppmv. The present burner is preferably used in high temperature furnace environments. At operating temperatures above the auto-ignition temperature of the fuel, where combustion is considered to be self-sustaining, the use of the primary injector 44 is not required and 100% of the fuel can be supplied through the secondary injector 48. In this operating mode, NOx levels are reduced to about 30 ppmv.

NOx production is greatly suppressed by firing through the secondary injector 48. Fuel supplied through the secondary injector 48 mixes with the inert furnace products entrained in the recirculation zone, substantially diluting the fuel with inerts prior to mixing with the combustion air stream diverging from the burner tile 36. Local oxygen concentrations are thus reduced by the presence of these inerts, slowing the rate of the combustion reaction, and lowering the combustion reaction temperature. The inerts must be heated to the reaction temperature, thus the temperature must be lower, reducing NOx generation.

Figure 4:
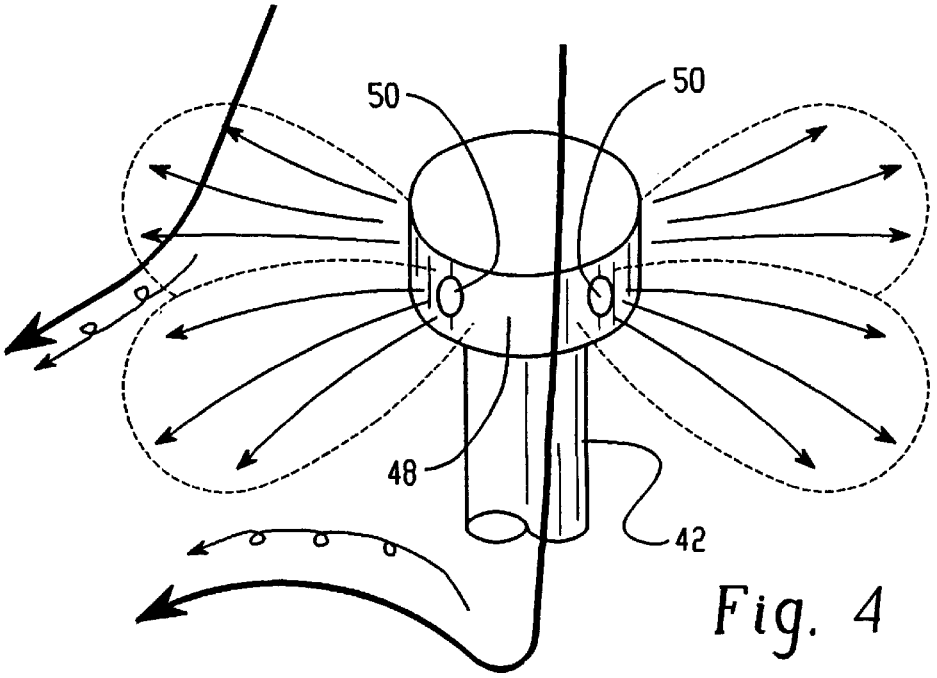
FIG. 4 is an oblique view illustrating the entrainment and mixing around the secondary injector of the present invention.

The ported geometry of the secondary injector 48 plays a role in achieving low NOx production rates. The inventors have observed that, surprisingly, a fewer number of ports 50 result in a lower NOx level. Numerous ports reduce the proportion of the entrained inert furnace products recirculated by the burner. The inventors have discovered that an injector 48 using eight ports 50 results in NOx levels of about 100 ppmv while an injector 48 using only four ports results in NOx levels of only about 30 ppmv. As seen in FIGS. 3 and 4, it is observed that the spacing between the four ports 50 contributes to the entrainment of inerts and allows the inert furnace products to become adequately interspersed between each of the fuel jets and also within the combustion air stream. Such spacing promotes mixing with the products of the primary stage and the entrained inerts along the entire perimeter of the secondary gas jets. The entrained gases cross the plane of the ports 50, promoting further mixing along the perimeter. However, fewer than four ports results in a poorly defined flame shape with excessively delayed mixing between the fuel and air streams. Thus, while the invention is not limited by the number of ports, the most satisfactorily results are presently observed using four ports.

The present invention also provides other benefits over and above reduced NOx production. The secondary injector 48 expands the flame diameter, resulting in a lower heat flux per unit of wall/roof surface area. At equivalent firing rates and other conditions, this will produce more uniform heating across the wall and roof of the furnace. Also, flow rates can be varied between the primary injector and the secondary injector to provide an optimum balance between NOx emission levels and wall/roof heat flux rates, thus providing significant flexibility over previous flat flame burners.

The secondary injector 48 provides energy to the secondary reactant parallel to the roof which will reduce the likelihood of the flat flame burner firing forward, a difficulty associated with all flat flame burners.

As described hereinabove, the present invention solves many problems associated with previous flat flame burners, and presents improved emissions reduction and operation. However, it will be appreciated that various changes in the details, materials and arrangements of parts which have been herein described and illustrated in order to explain the nature of the invention may be made by those skilled in the art within the principle and scope of the invention as expressed in the appended claims.

We claim:

1. A flat flame burner comprising:

a burner tile for reacting a combustible mixture to produce a flame, said burner tile having an outlet passage with a radially divergent surface;

means forming a first passage for admitting a primary reactant flow into the burner tile;

means forming a second passage including a primary injector, at a position upstream of the burner tile, for admitting a first flow of a secondary reactant into the primary reactant flow so as to create the combustible mixture;

means for rotating the flow of primary reactant within the first passage wherein the rotational flow cooperates with the divergent surface of the burner tile to produce a radially divergent flame at the outlet, and wherein the rotational flow entrains inert gases from an environment ambient to the burner;

wherein said second passage also includes a secondary injector, substantially proximate to a downstream end of said outlet passage of said burner tile for admitting a second flow of secondary reactant radially into the entrained inert gases.

2. The flat flame burner of claim 1 wherein the first passage is substantially cylindrical and said second passage is a tube substantially concentric with the first passage.

3. The flat flame burner of claim 1 wherein at least a portion of the divergent surface has a profile being conical in shape.

4. The flat flame burner of claim 1 wherein at least a portion of the divergent surface of the burner tile is curved.

5. The flat flame burner of claim 4 wherein at least a portion of the divergent surface of the burner tile has a profile being conic-sectional in shape.

6. The flat flame burner of claim 5 wherein at least a portion of the divergent surface of the burner tile is hyperboloidal.

7. The flat flame burner of claim 1 wherein the secondary injector includes a plurality of injection ports.

8. The flat flame burner of claim 7 wherein the secondary injector includes four injection ports.

9. The flat flame burner of claim 1 wherein the primary reactant is air and the secondary reactant is gaseous fuel.

10. A method of producing a low NOx flat flame comprising the steps of:

providing a burner tile for reacting a combustible mixture to produce a flame, said burner tile having an outlet passage with a divergent surface;

admitting a primary reactant flow into the burner tile;

admitting a first secondary reactant flow into the primary reactant flow, at a position upstream of the burner tile, so as to create the combustible mixture;

producing a rotational flow of the primary reactant flow upstream of the burner tile, wherein the rotational flow cooperates with the divergent surface to produce a radially divergent flow at the outlet, wherein the rotational flow entrains inert gases from an environment ambient to the burner;

wherein a second secondary reactant flow is admitted radially into the entrained inert gases, substantially proximate to a downstream end of the outlet passage, and combusts with the radially divergent flow, so as to result in a low NOx combustion reaction.

11. The method of claim 10 wherein, upon attainment of a predetermined furnace temperature, the first secondary reactant flow is discontinued so that the second secondary reactant flow sustains the low NOx combustion reaction.

12. The method of claim 10 wherein the primary reactant is air and the secondary reactant is gaseous fuel.

* * * * *